US011035353B2

(12) United States Patent
Albertin et al.

(10) Patent No.: US 11,035,353 B2
(45) Date of Patent: Jun. 15, 2021

(54) VOLUMETRIC PUMP

(71) Applicants: Edoardo Albertin, Due Carrare (IT); Giacomo Boin, Albignasego (IT)

(72) Inventors: Edoardo Albertin, Due Carrare (IT); Giacomo Boin, Albignasego (IT)

(73) Assignees: Edoardo Albertin, Due Carrare (IT); Giacomo Boin, Albignasego (IT); Flavio Vedovato, Padua (IT)

( * ) Notice: Subject to any disclaimer, the term of this patent is extended or adjusted under 35 U.S.C. 154(b) by 25 days.

(21) Appl. No.: 16/349,362

(22) PCT Filed: Nov. 9, 2017

(86) PCT No.: PCT/EP2017/078804
§ 371 (c)(1),
(2) Date: May 13, 2019

(87) PCT Pub. No.: WO2018/091355
PCT Pub. Date: May 24, 2018

(65) Prior Publication Data

US 2019/0264672 A1 Aug. 29, 2019

(30) Foreign Application Priority Data

Nov. 15, 2016 (IT) ..... IT102016000114952

(51) Int. Cl.
*F04B 43/00* (2006.01)
*F04B 43/04* (2006.01)
(Continued)

(52) U.S. Cl.
CPC ..... *F04B 43/0054* (2013.01); *F04B 9/00* (2013.01); *F04B 17/00* (2013.01);
(Continued)

(58) Field of Classification Search
CPC ..... F04B 43/0054; F04B 43/0063; F04B 43/0072; F04B 45/02; F04B 45/041; F04B 45/043; F04B 45/045; F04B 45/047
(Continued)

(56) References Cited

U.S. PATENT DOCUMENTS 3,733,616 A 5/1973 Willis, Jr.
3,768,931 A * 10/1973 Willis, Jr. ..... A61M 1/1053 417/322

(Continued)

FOREIGN PATENT DOCUMENTS

DE 1553173 A1 12/1969

OTHER PUBLICATIONS

International Search Report and Written Opinion dated Dec. 15, 2017 issued in PCT/EP2017/078804.

(Continued)

*Primary Examiner* — Patrick Hamo
(74) *Attorney, Agent, or Firm* — Scully, Scott, Murphy & Presser, P.C.

(57) ABSTRACT

A volumetric pump, comprising:
at least one deformable enclosure, which defines at least one variable-volume chamber, each of the at least one chamber being provided with an intake passage and with an outflow passage,
magnetically-actuated elements, which act on portions of the deformable closure in order to deform the deformable enclosure between an extended configuration, having a larger volume, and a compressed configuration, having a smaller volume,
drive elements for the actuation of the magnetically-actuated elements,
a load-bearing frame on which the at least one deformable enclosure and the drive elements are mounted.

11 Claims, 5 Drawing Sheets

(51) Int. Cl.

| | |
|---|---|
| ***F04B 43/113*** | (2006.01) |
| ***F04B 53/10*** | (2006.01) |
| ***F04B 17/00*** | (2006.01) |
| ***F04B 9/00*** | (2006.01) |

(52) U.S. Cl.
CPC ..... *F04B 43/0045* (2013.01); *F04B 43/04* (2013.01); *F04B 43/113* (2013.01); *F04B 53/10* (2013.01)

(58) Field of Classification Search
USPC ..... 417/322
See application file for complete search history.

(56) References Cited

U.S. PATENT DOCUMENTS 4,154,559 A * 5/1979 Enomoto ..... F04B 45/043 417/413.1
6,074,179 A * 6/2000 Jokela ..... F04B 43/04 417/322
6,249,198 B1 * 6/2001 Clark ..... F04B 45/047 335/229
6,607,368 B1 * 8/2003 Ross ..... F04B 43/084 417/412
8,197,234 B2 * 6/2012 Gharib ..... H02K 41/031 417/474
2004/0265150 A1 12/2004 McElfresh et al.
2013/0008545 A1 1/2013 Chan et al.

OTHER PUBLICATIONS

Italian Search Report dated Sep. 15, 2017 issued in IT 201600114952, with partial translation.

* cited by examiner

VOLUMETRIC PUMP

The present invention relates to a volumetric pump.

Nowadays, for moving liquids, there are several kinds of pump: volumetric, fluid-dynamic, and hydraulic.

They impart a motion to a fluid that is directly proportional to the energy applied for their operation.

Generally, conventional volumetric pumps have the following principal drawbacks:

Relatively high electricity consumption in proportion to the work that they are called on to do, The need for careful maintenance, often owing to friction between components that move relative to each other, or owing to the imperfect seal between such components.

In particular, such limitations make the use of conventional volumetric pumps complex when applied in certain fields, such as for example the medical field.

The aim of the present invention is to provide a volumetric pump that is capable of improving the known art in one or more of the above mentioned aspects.

Within this aim, an object of the invention is to provide a volumetric pump that offers lower energy consumption than a conventional volumetric pump for the same performance.

Another object of the invention is to provide a volumetric pump that is simple, compact and safe, therefore which requires less maintenance than a similar, conventional volumetric pump.

Another object of the invention is to provide a volumetric pump that can also be used in the medical field.

Furthermore, another object of the present invention is to overcome the drawbacks of the known art in a different manner to any existing solutions.

This aim and these and other objects which will become better apparent hereinafter are achieved by a volumetric pump according to claim 1, optionally provided with one or more of the characteristics of the dependent claims.

Further characteristics and advantages of the invention will become better apparent from the description of two preferred, but not exclusive, embodiments of the volumetric pump according to the invention, which are illustrated for the purposes of non-limiting example in the accompanying drawings wherein.

Figure 1:
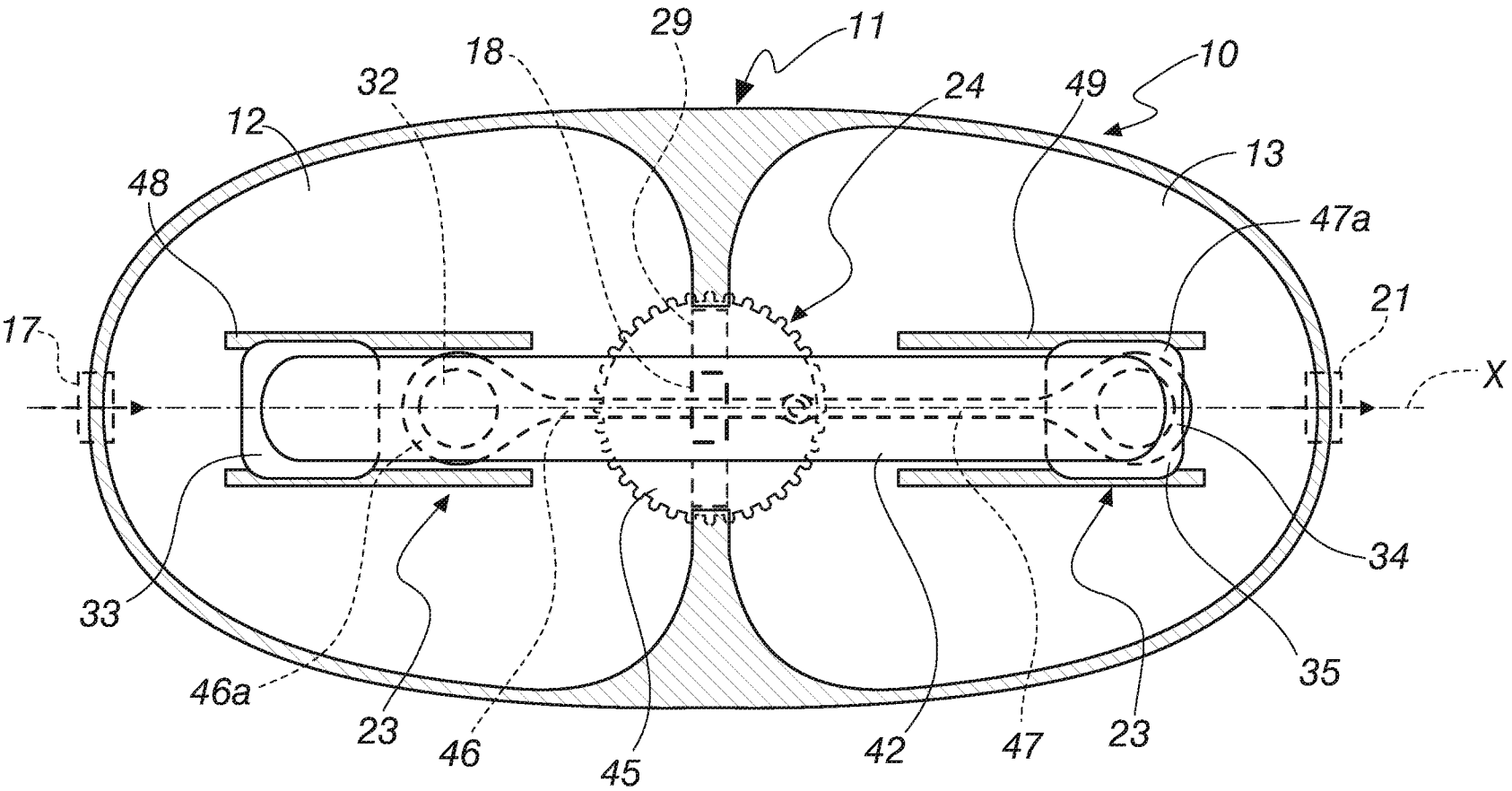
FIG. 1 is a plan view of a volumetric pump according to the invention in a first embodiment thereof.

With reference to the figures, a volumetric pump according to the invention is generally designated by the reference numeral 10.

Figure 2:
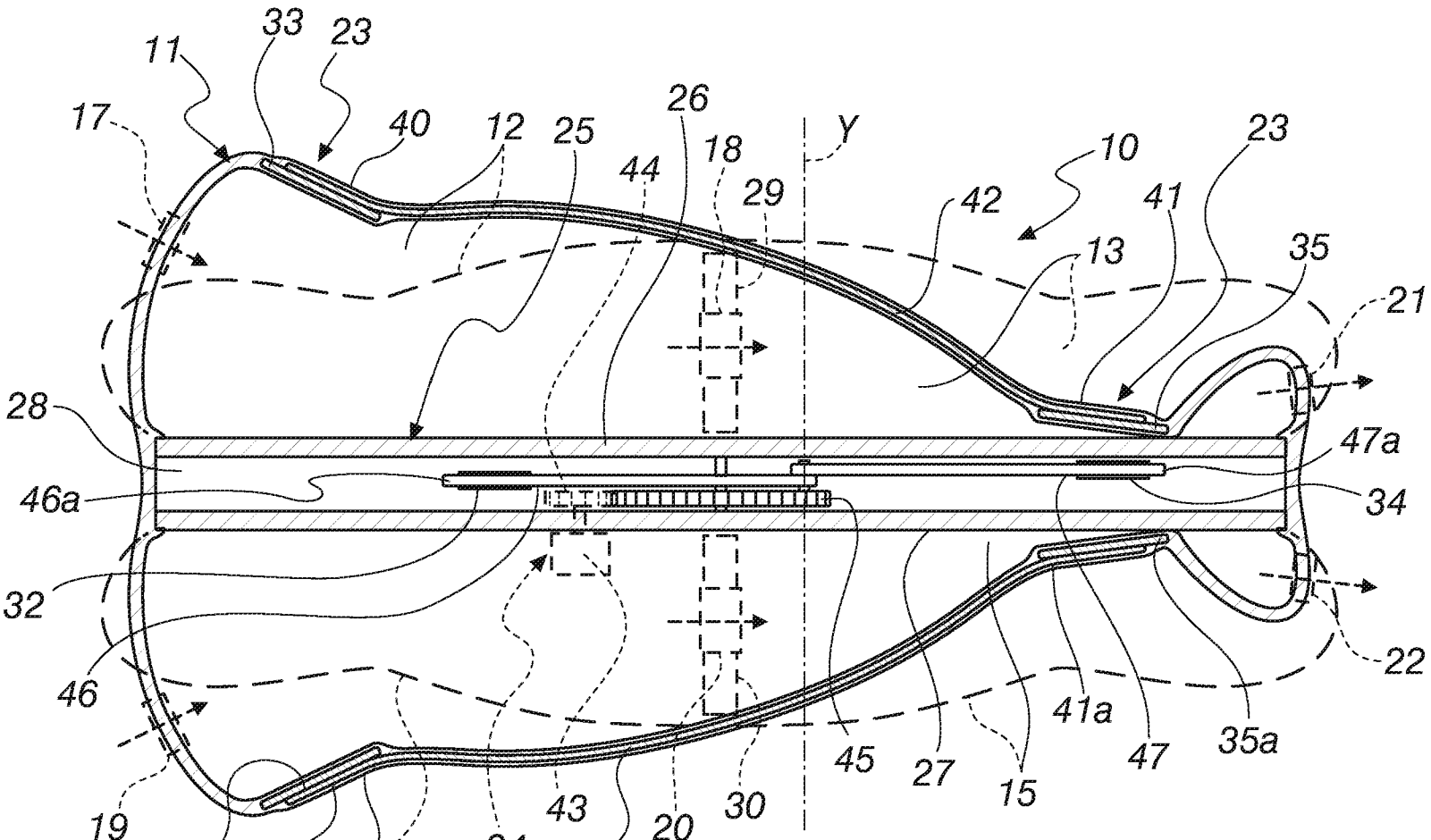
FIG. 2 is a cross-sectional side view of the pump in FIG. 1.

Such volumetric pump 10, in a first embodiment thereof shown in FIGS. 1 and 2, comprises:

a deformable enclosure 11 that defines four variable-volume chambers 12, 13, 14 and 15, each one of such chambers 12, 13, 14 and 15 having an intake passage 17, 18, 19 and 20 and an outflow passage 18, 20, 21 and 22, magnetically-actuated means 23, which act on portions of the deformable enclosure 11 in order to deform that deformable enclosure 11 between an extended configuration, having a larger volume in the variable-volume chambers, and a compressed configuration, having a smaller volume in the variable-volume chambers, drive means 24 for the actuation of the magnetically-actuated means 23, a load-bearing frame 25 on which the deformable enclosure 11 and the drive means 24 are mounted.

In such first embodiment, the deformable enclosure 11 is constituted by a closed bag made of plastic material, inside which the load-bearing frame 25 with the drive means 24 is enclosed.

Such closed bag is contoured so as to define those four variable-volume chambers 12, 13, 14 and 15, respectively the first chamber 12, the second chamber 13, the third chamber 14 and the fourth chamber 15.

The load-bearing frame 25 comprises two walls 26 and 27 which face each other so as to define an interspace 28 that accommodates at least part of the drive means 24, better described hereinbelow.

The load-bearing frame 25 also comprises two intermediate partitions 29 and 30, which extend transversely to a corresponding wall 26 and 27.

Each one of the variable-volume chambers 12, 13, 14, 15 is defined between a portion of the enclosure 11, a portion of a wall 26 or 27 and an intermediate partition 29 or 30, which extends from the corresponding wall 26 or 27.

In such embodiment, one variable-volume chamber 12, 13, 14 and 15 is connected to another of these variable-volume chambers.

For example the first chamber 12 is connected to the second chamber 13, both being defined on the same side of a first wall 26, while the third chamber 14 is connected to the fourth chamber 15, both being defined on the same side of the second wall 27.

The first chamber 11 has a first intake passage 17, which is connected to the outside of the enclosure 11, and a first outflow passage 18, which is defined for example on the intermediate partition 29 between the two chambers 12 and 13.

The second chamber 13 therefore has a second intake passage which is constituted by the first outflow passage 18 on the intermediate partition 29, and a second outflow passage 21, connected to the outside of the enclosure 11.

Similarly, the third chamber 14 has a third intake passage 19, which is connected to the outside of the enclosure 11, and a third outflow passage 20, which is defined for example on the intermediate partition 30 between the two chambers 14 and 15.

The fourth chamber 15 therefore has a fourth intake passage which is constituted by the third outflow passage 20 on the intermediate partition 30, and a fourth outflow passage 22, connected to the outside of the enclosure 11.

The intake and outflow passages 17, 19, 21 and 22 that are connected to the outside are for example connected to the tubular elements for the inflow and the outflow of a fluid.

The passages 18 and 20 between two communicating variable-volume chambers each have a corresponding one-way valve, not shown for the sake of simplicity and which should be understood as being of known type, so as to render the motion of the pumped fluid unidirectional from one chamber to the other.

The magnetically-actuated means 23, in the present embodiment, comprise, for each one of the variable-volume chambers 12, 13, 14, 15, two magnetic bodies 32, 33, 34 and 35, for example two, 32 and 33, for the first chamber 12, and two, 34 and 35, for the adjacent second chamber 13, which are preset to attract or repel each other mutually, a first magnetic body 32 and 34, which is moved by the drive means 24 in the interspace 28, a second magnetic body 33 and 35, which is fixed to the enclosure 11 in such a position as to undergo the magnetic attraction or repulsion of the first magnetic body 32 and 34 when the latter is substantially at the second magnetic body 33 and 35, i.e. when, in the case of attraction, the second magnetic body 33 and 35, with the corresponding portion of enclosure 11 in the extended configuration, and not compressed, is at the minimum distance from the first magnetic body 32 and 34, or, in the case of repulsion, the second magnetic body 33 and 35, with the corresponding portion of enclosure 11 in the compressed configuration, is in contact with or proximate to the first magnetic body 32 and 34.

For example, in the case of attraction of the first and second magnetic bodies, when the drive means 24 bring a first magnetic body 32 and 34 to the respective second magnetic body 33 and 35, the attraction between the two produces the movement of the second magnetic body 33 and 35 toward the first magnetic body 32 and 34, with consequent collapse of the portion of enclosure 11 on which the second magnetic body 33 and 35 is fixed, and consequent decrease in the volume of the corresponding variable-volume chamber, for example 12 and 13.

In a variation of embodiment, not shown for the sake of simplicity, the deformable enclosure 11 is elastically deformable, so that when the first magnetic body 32 and 34 is distanced from the second magnetic body 33 and 35, and therefore the magnetic attraction decreases, the portion of deformable enclosure 11 returns from the collapsed configuration to the extended configuration, with consequent increase in volume of the corresponding variable-volume chamber.

In the example described herein, the second magnetic bodies 33 and 35 for two variable-volume chambers 12 and 13, the latter arranged on the same side of the load-bearing frame 25 and mutually opposite with respect to an intermediate partition 29, are supported by a lever 42, to the opposite ends 40 and 41 of which they are respectively fixed.

Similarly, the second magnetic bodies 33*a* and 35*a* for the other two variable-volume chambers 14 and 15, the latter arranged on the same side of the load-bearing frame 25 and mutually opposite with respect to an intermediate partition 30, are supported by a lever 42*a*, to the opposite ends 40*a* and 41*a* of which they are respectively fixed.

Such lever 42 and 42*a* is constituted, for example, by a flat bar.

Such lever 42 and 42*a* is positioned across the partition 29 and 30.

Such lever 42 and 42*a* is incorporated, together with the second magnetic bodies 33, 33*a*, 35 and 35*a*, in the deformable enclosure 11.

The drive means 24 for the actuation of the magnetically-actuated means 23 are adapted to move the first magnetic bodies 32 and 34 according to an alternating translational motion in the two opposite directions of a same line X.

Such drive means 24 comprise an electric motor 43 that is adapted to move a rod-and-crank system, which comprises a crank element and two opposing rod elements, the rod elements each supporting a first magnetic body 32 and 34 respectively.

In the present, obviously non-limiting embodiment of the invention, the rod-and-crank system comprises a gearwheel 45 as the crank element, eccentrically to which two opposing rods 46 and 47 are pivoted, each of which supports at the end a first magnetic body 32 and 34 respectively.

The rods 46 and 47 are pivoted about a same axis Y, parallel to the axis of the rotating shaft of the electric motor 43.

The rods 46 and 47 have a widened head 46*a* and 47*a* which is arranged so as to slide in a corresponding straight guide 48 and 49.

The straight guides 48 and 49 extend along the axis X.

The gearwheel 45 is meshed with a pinion 44 which is fixed to the rotating shaft of the electric motor 43.

In a variation of embodiment, not shown for the sake of simplicity, the gearwheel 45 is fixed directly to the rotating shaft of an electric motor, without the interposition of pinions or other elements for transmitting the motor torque.

The electric motor 43 is advantageously powered by batteries.

Such batteries are arranged proximate to the electric motor, or incorporated in it.

Figure 5:
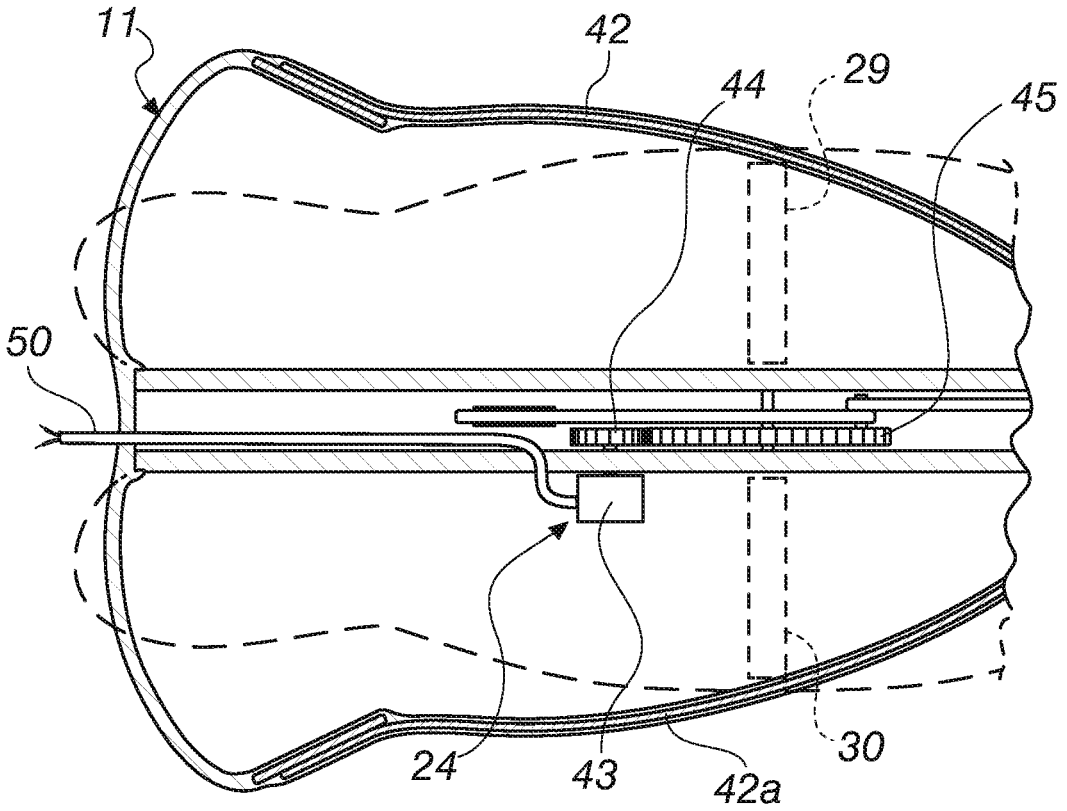
FIG. 5 is a schematic view of a variation of embodiment of the volumetric pump according to the invention.

In a variation of embodiment of the invention, shown for the purposes of example in FIG. 5, the electric motor 43 is powered through cable wires 50 that extend so as to exit from the deformable enclosure 11, for example at the portion of the enclosure that is positioned so as to affect the interspace 28.

In general, such batteries are conveniently fixed to the load-bearing frame 25, inside the deformable enclosure 11; in this manner the volumetric pump 10 does not require electrical power connections to external sources.

Operation of the volumetric pump 10 according to the invention is the following.

The electric motor 43 produces the rotation of the gearwheel 45, which in turn produces the movement of the rods 46 and 47 and the consequent alternating translational motion in the direction defined by the axis X of the first magnetic bodies 32 and 34.

When a first magnetic body 32 and 34 is at a respective second magnetic body 33 and 35, but also 33*a* and 35*a*, fixed to the enclosure 11, such second magnetic body 33 and 35, and 33*a* and 35*a*, is attracted, making the corresponding variable-volume chamber 12, 13, 14, 15 collapse.

The alternating translational motion of the two first magnetic bodies 32 and 34 has the result that when a first one of the first magnetic bodies 32 exits from the magnetic field of the respective second magnetic body 33, the second of those first magnetic bodies 34 will begin to act in the same manner on the other second magnetic body 35.

The rod 42 facilitates and ensures the alternating distancing of the second magnetic body 33 and 35 from the respective first magnetic body 32 and 34, acting as a form of seesaw pivoted on the partition 29.

In this manner, it is ensured that two mutually connected variable-volume chambers 12 and 13 are never both in the extended configuration, and never both in the compressed configuration.

Operation for the other two chambers 14 and 15, arranged on the other side of the load-bearing frame 25 with respect to the two chambers 12 and 13, is mirror-symmetrical.

In this manner, by taking advantage of the pressure generated by the alternating collapsing of the connected chambers 12 and 13, and 14 and 15, a fluid moves for example from outside to the inside of a first chamber 12 and 14, from there to a connected chamber 13 and 15, and from there to the outside of the volumetric pump 10.

The non-return valves arranged internally or externally ensure that the pumped fluid goes in the desired direction.

Variable-volume chambers and rod elements can be added on the crank as space permits, so as to take maximum advantage of the movement of the electric motor.

Such volumetric pump 10 can be provided in different sizes as long as the ratio between the components is maintained. The operation is possible both with the magnetic bodies arranged so as to attract each other, and with them arranged so as to repel each other.

Figure 3:
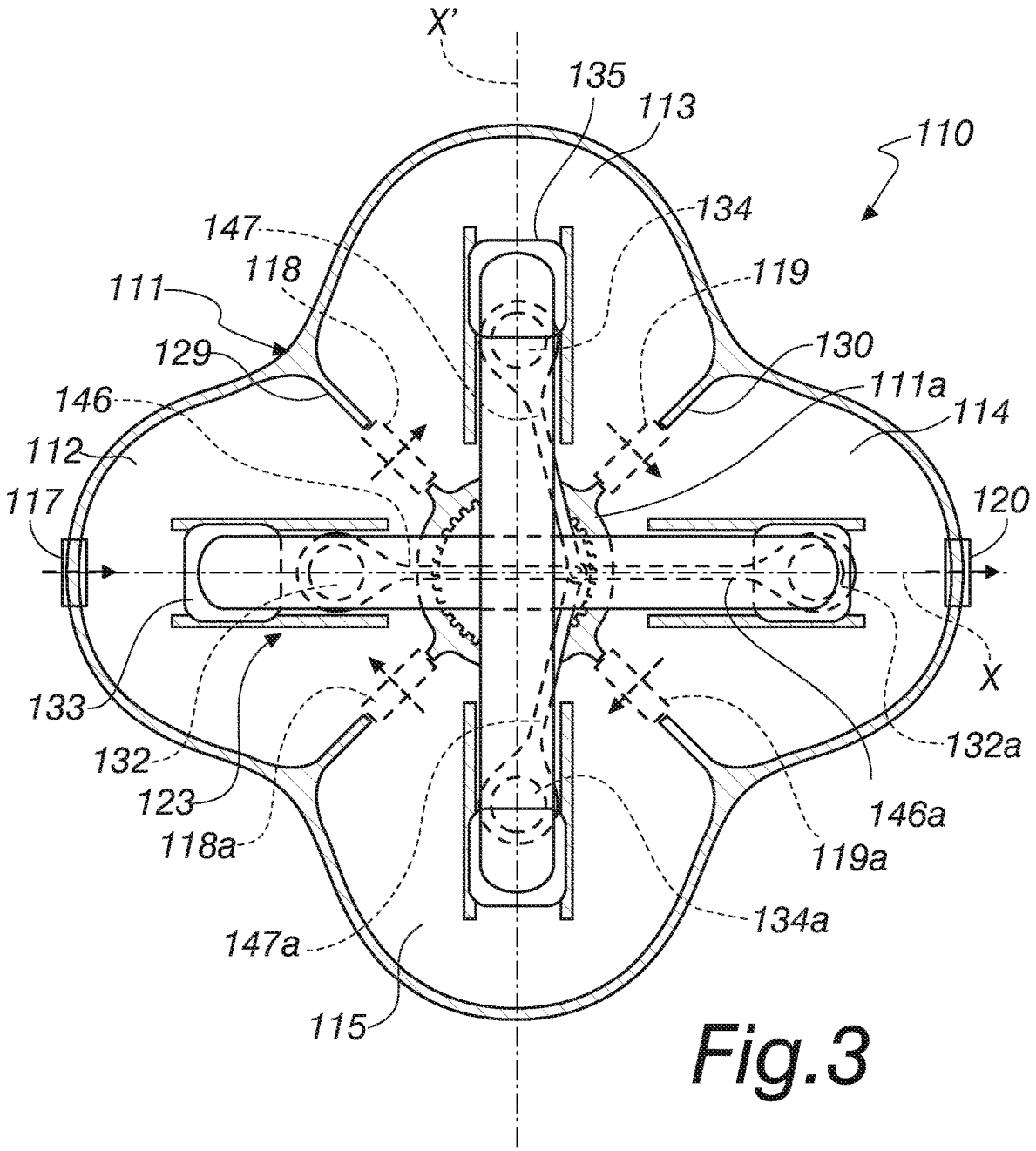
FIG. 3 is a plan view of a volumetric pump according to the invention in a second embodiment thereof.
Figure 4:
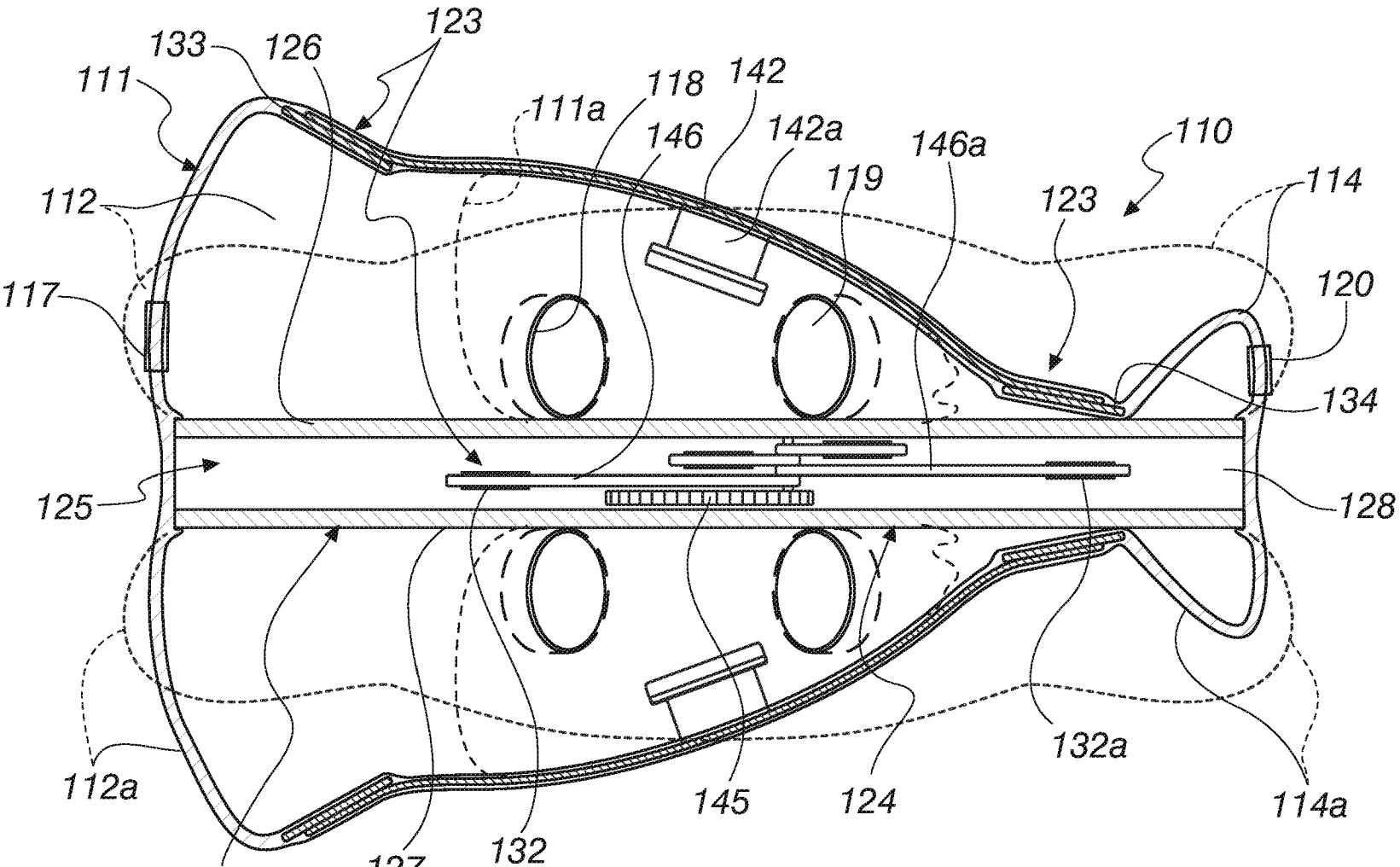
FIG. 4 is a cross-sectional side view of the pump in FIG. 3.

FIGS. 3 and 4 show a volumetric pump according to the invention in a second embodiment thereof, generally designated therein with the reference numeral 110.

In such second embodiment shown, such volumetric pump 110 comprises:

- a deformable enclosure 111 that defines eight variable-volume chambers, four upper chambers 112, 113, 114, 115, and four mirror-symmetrical lower chambers, of which two opposing chambers 112*a* and 114*a* can be seen in FIG. 4, each one of such chambers having at least one intake passage, for example 117, 118, 119 and at least one outflow passage 118, 119, and 120,
- magnetically-actuated means 123, which act on portions of the deformable enclosure, in order to deform that deformable enclosure 111 between an extended configuration, having a larger volume in the variable-volume chambers, and a compressed configuration, having a smaller volume in the variable-volume chambers, as described above for the first embodiment,
- drive means 124 for the actuation of the magnetically-actuated means 123,
- a load-bearing frame 125 on which the deformable enclosure 111 and the drive means 124 are mounted.

Also in such second embodiment, the deformable enclosure 111 is constituted by a closed bag made of plastic material, inside which the load-bearing frame 125 with the drive means 124 is enclosed.

In such embodiment, the outflow passage 118 for the first chamber 112 is also the intake passage for the second chamber 113, and similarly the outflow passage 119 of the second chamber 113 is the intake passage for the third chamber 214.

In such embodiment, the first chamber 112 has two outflow passages, a first outflow passage 118 to the second chamber 113, and a second outflow passage 118*a* to the fourth chamber 115.

Similarly, the third chamber 114 has two intake passages, a first intake passage 119 from the second chamber 113 and a second intake passage 119*a* from the fourth chamber 115.

The load-bearing frame 125 comprises two walls 126 and 127 which face each other so as to define an interspace 128 that accommodates at least part of the drive means 124.

The deformable enclosure 111 comprises, for each part of the load-bearing frame 125, radial partitions, for example 129 and 130, which extend transversely to a corresponding wall 126 and 127, and are adapted to divide two laterally adjacent variable-volume chambers, and a central partition 111*a*, for example cylindrical or the like, which is adapted to divide the chambers arranged oppositely.

Each one of the variable-volume chambers 112, 113, 114, 115, 112*a*, 114*a* is defined between a portion of the enclosure 111, a portion of a wall 126 or 127, an intermediate partition 129 or 130 and a portion of the central partition 111*a*.

The magnetically-actuated means 123, in the present embodiment, comprise, for each one of said variable-volume chambers 112, 113, 114, 115, two magnetic bodies, for example 132 and 133 for the first chamber 112, and 134 and 135 for the adjacent second chamber 113, which are adapted to attract each other mutually,

- a first magnetic body 132 and 134, which is moved by the drive means 124 in the interspace 128,
- a second magnetic body 133 and 135, which is fixed to the enclosure 111 in such a position as to undergo the magnetic attraction of the first magnetic body 132 and 134 when the latter is substantially at the second magnetic body 133 and 135.

The drive means 124 for the actuation of the magnetically-actuated means 123 are adapted to move the first magnetic bodies 132 and 134 according to an alternating translational motion in the two opposite directions of a first line X for a first one 132 of the first magnetic bodies, and of a second line X', transverse to the first line, for a second one 134 of the first magnetic bodies.

Such drive means 124 comprise an electric motor, not shown but as described above for the first embodiment, which is adapted to move a rod-and-crank system, which comprises a crank element and four rod elements, the rod elements each supporting a first magnetic body 132 and 134, 132*a* and 134*a*.

Such four rod elements operate in pairs, two first rod elements in a first direction X and two second rod elements in the second direction X'.

In the present, obviously non-limiting embodiment of the invention, the rod-and-crank system comprises a gearwheel 145 as the crank element, eccentrically to which opposing pairs of rods 146 and 147, 146*a* and 147*a* are pivoted, each of which supports at the end a first magnetic body.

The rods 146 and 147, 146*a* and 147*a* are pivoted about a same axis Y, parallel to the axis of the rotating shaft of the electric motor.

Similarly to what is described above, the second magnetic bodies 133 and 134 for two opposing variable-volume chambers, for example 112 and 114, the latter arranged on the same side of the load-bearing frame 125 and mutually opposite with respect to the central partition 111*a*, are supported by a lever 142 and 142*a*, to the opposite ends of which they are respectively fixed.

The two levers 142 and 142*a* which are located on the same side of the load-bearing frame 125 are arranged at right angles to each other.

In practice it has been found that the invention fully achieves the intended aim and objects.

In particular, with the invention a volumetric pump has been devised that offers lower energy consumption than a similar conventional volumetric pump for the same performance, since a small amount of electricity is sufficient in order to produce the movement of the first magnetic bodies, while the pumping action is achieved by the magnetic means which take advantage of the magnetic attraction, or repulsion, between the first and the second magnetic bodies, without therefore consuming any electricity.

Furthermore, with the invention a volumetric pump has been devised that is simple, compact and safe, therefore requiring less maintenance than a similar, conventional volumetric pump, since the magnetic actuation means do not produce friction and the risks of wear and therefore breakage are reduced to the minimum for the drive means as well.

What is more, with the invention a volumetric pump has been devised that can also be used in the medical field, since for its production non-toxic materials can be used that are compatible with the human body.

The invention, thus conceived, is susceptible of numerous modifications and variations, all of which are within the scope of the appended claims. Moreover, all the details may be substituted by other, technically equivalent elements.

In practice the components and the materials employed, provided they are compatible with the specific use, and the contingent dimensions and shapes, may be any according to requirements and to the state of the art.

The disclosures in Italian Patent Application No. 102016000114952 (UA2016A008227) from which this application claims priority are incorporated herein by reference.

The invention claimed is:

1. A volumetric pump, comprising:

at least one deformable enclosure, which defines at least one variable-volume chamber, each of said at least one variable-volume chamber being provided with an intake passage and with an outflow passage, a magnetic body that is configured to act on portions of said at least one deformable enclosure in order to deform said at least one deformable enclosure between an extended configuration, having a larger volume, and a compressed configuration, having a smaller volume, a motor configured to actuate said magnetic body, a load-bearing frame on which said at least one deformable enclosure and said motor are mounted, wherein said deformable enclosure is constituted by a closed bag made of plastic material, inside which the load-bearing frame with the motor is enclosed.

2. The volumetric pump according to claim 1, wherein said load-bearing frame comprises two walls which face each other so as to define an interspace that accommodates at least part of said motor.

3. A volumetric pump, comprising:

at least one deformable enclosure, which defines at least one variable-volume chamber, each of said at least one variable-volume chamber being provided with an intake passage and with an outflow passage, a magnetic body that is configured to act on portions of said at least one deformable enclosure in order to deform said at least deformable enclosure between an extended configuration, having a larger volume, and a compressed configuration, having a smaller volume, a motor configured to actuate said magnetic body, a load-bearing frame on which said at least one deformable enclosure and said motor is mounted, wherein said load-bearing frame comprises two walls which face each other so as to define an interspace that accommodates at least part of said motor, and, wherein said load-bearing frame comprises two intermediate partitions, which extend transversely to a corresponding wall of said two walls.

4. A volumetric pump, comprising at least one deformable enclosure, which defines at least one variable-volume chamber, each of said at least one variable-volume chamber being provided with an intake passage and with an outflow passage, a magnetic body that is configured to act on portions of said at least one deformable enclosure in order to deform said at least one deformable enclosure between an extended configuration, having a larger volume, and a compressed configuration, having a smaller volume, a motor configured to actuate said magnetic body, a load-bearing frame on which said at least one deformable enclosure and said motor is mounted, wherein said at least one variable-volume chamber comprises at least two variable-volume chambers, and wherein each one of said variable-volume chambers is defined between a portion of the enclosure, a portion of two walls and an intermediate partition, which extends from the corresponding wall.

5. A volumetric pump, comprising:

at least one deformable enclosure, which defines at least one variable-volume chamber, each of said at least one variable-volume chamber being provided with an intake passage and with an outflow passage, a magnetic body that is configured to act on portions of said at least one deformable enclosure in order to deform said at least one deformable enclosure between an extended configuration, having a larger volume, and a compressed configuration, having a smaller volume, a motor configured to actuate said magnetic body, a load-bearing frame on which said at least one deformable enclosure and said motor is mounted, wherein said at least one variable-volume chamber comprises at least two variable-volume chambers that are in communication via a passage, wherein the passage comprises a one-way valve.

6. A volumetric pump, comprising:

at least one deformable enclosure, which defines at least one variable-volume chamber, each of said at least one variable-volume chamber being provided with an intake passage and with an outflow passage, a magnetic body that is configured to act on portions of said at least one deformable enclosure in order to deform said at least one deformable enclosure between an extended configuration, having a larger volume, and a compressed configuration, having a smaller volume, a motor configured to actuate said magnetic body, a load-bearing frame on which said at least one deformable enclosure and said motor is mounted, wherein said at least one variable-volume chamber comprises at least two variable-volume chambers, and wherein said magnetic body comprises for each one of said variable-volume chambers, two magnetic bodies, a first pair for a first chamber, and a second pair for an adjacent second chamber, which are preset to attract or repel each other mutually, a first magnetic body of each of the first pair and the second pair, which is configured to move by the motor in the interspace, a second magnetic body of each of the first pair and the second pair, which is fixed to the enclosure in such a position as to undergo the magnetic attraction or repulsion of the first magnetic body of each of the first pair and the second pair.

7. The volumetric pump according to claim 6, wherein the second magnetic body of each of the first pair and the second pair for two variable-volume chambers, the latter arranged on the same side of the load-bearing frame and mutually opposite with respect to an intermediate partition, are supported by a lever, to the opposite ends of which they are respectively fixed.

8. The volumetric pump according to claim 6, wherein said motor is adapted to move the first magnetic body of each of the first pair and the second pair according to an alternating translational motion in the two opposite directions of a same line.

9. The volumetric pump according to claim 6, wherein said motor is adapted to move a rod-and-crank system, which comprises a crank element and at least two opposing rod elements, said rod elements each supporting said first magnetic body of each of the first pair and the second pair.

10. The volumetric pump according to claim 9, wherein said rod-and-crank system comprises a gearwheel as the crank element, eccentrically to which two opposing rods are pivoted, each of which supports at the end one of the first magnetic bodies of each of the first pair and the second pair.

11. The volumetric pump according to claim 10, wherein said rods have a widened head which is arranged so as to slide in a corresponding straight guide.

* * * * *